United States Patent [19]

Farrar et al.

[11] Patent Number: 4,699,590

[45] Date of Patent: Oct. 13, 1987

[54] MODULAR CONNECTOR ASSEMBLY AND FILTERED INSERT THEREFOR

[75] Inventors: John C. Farrar, Harrisburg; James L. Schroeder, III, Palmyra; Patrick F. Yeager, Middletown, all of Pa.

[73] Assignee: AMP Incorporated, Harrisburg, Pa.

[21] Appl. No.: 793,357

[22] Filed: Oct. 31, 1985

[51] Int. Cl.[4] ..... H01R 13/66

[52] U.S. Cl. ..... 439/95; 439/620

[58] Field of Search ..... 339/14 R, 143 R, 147 R; 333/181, 182

[56] References Cited

U.S. PATENT DOCUMENTS

| | | | |
|---|---|---|---|
| 3,200,355 | 8/1965 | Dahlen | 339/147 R X |
| 4,144,509 | 3/1979 | Boutros | 333/181 |
| 4,222,626 | 9/1980 | Hollyday et al. | 339/147 R |
| 4,262,268 | 4/1981 | Shimada et al. | 333/182 |
| 4,494,092 | 1/1985 | Griffin | 339/147 R X |

FOREIGN PATENT DOCUMENTS

| | | | |
|---|---|---|---|
| 2137436 | 10/1984 | United Kingdom | 339/147 R |

OTHER PUBLICATIONS

"ARINC 404 Rack and Panel Connectors", Catalog 73-162, revised 8-84, AMP Incorporated, Harrisburg, PA 17105.

"ARINC 600 Connectors, Contacts, and Accessories", Data Sheet 83-724, Revised 4-85, AMP Incorporated, Harrisburg, PA 17105.

*Primary Examiner*—Eugene F. Desmond

*Attorney, Agent, or Firm*—Katherine A. Nelson

[57] ABSTRACT

Modular electrical connector assemblies and filtered connector inserts therefor. The assembly includes one or more connector inserts removably mounted within an outer shell. The filtered insert comprises a housing means, at least a portion of which is electrically conductive; at least one electrical contact within the housing means; and filter means within the housing electrically coupled to the contact for filtering interference, and electrically coupled to the conductive housing portion for providing a grounding path from the filter means to the conductive housing portion. Means are also provided for electrically coupling the conductive housing portion of the insert to the outer shell automatically when the insert is positioned in and mounted to the shell to provide an external grounding path from the conductive housing portion to the shell. With the invention connection of the grounding plane of the insert to external ground is achieved automatically upon mounting of the insert to the shell without requiring a solder connection and without using complex mounting springs or grounding clips, thus retaining the ability to easily mount and remove the filtered insert from the shell. The filtered insert preferably also has the same dimensions and contact placement as its corresponding unfiltered insert, and is fully interchangeable therewith.

19 Claims, 7 Drawing Figures

MODULAR CONNECTOR ASSEMBLY AND FILTERED INSERT THEREFOR

The Government has rights in this invention pursuant to Contract No. AF 33657-81-C-0067 awarded by the Department of Defense.

FIELD OF THE INVENTION

The present invention relates generally to electrical connector assemblies and, more particularly, to modular connector assemblies containing one or more connector inserts, and to filtered connector inserts for use in such assemblies.

BACKGROUND OF THE INVENTION

High-density, multiple-contact, electrical connectors are used in a variety of applications. For example, in aircraft, such connectors are often used to interface wiring from various locations throughout the aircraft with processing circuitry located within a bulkhead of the aircraft.

For convenience and flexibility, it is known to manufacture such connectors in the form of modular assemblies in which one or more connector modules or inserts are supported within an outer shell. Both the outer shell and the inserts are manufactured in a variety of standard configurations; and to form a connector assembly suitable for a particular application of interest, it is only necessary to select the appropriate shell and inserts and mount the inserts within the shell. The assembly as a whole can then be mounted to a bulkhead or other mounting surface for use.

For even greater flexibility, the inserts are removably mounted within the shell. Accordingly, if replacement of a particular insert is desired, it is a simple matter to remove the insert from the shell and mount a new insert in its place. It is not necessary to replace the assembly as a whole or to interfere with other inserts in the assembly.

There are many applications in which it is desirable to provide a connector insert with a filtering capability; for example, to supress EMI or RFI interference or other undesired signals which may exist in circuits connected by the inserts. To retain the convenience and flexibility of the connector assemblies, however, it is desirable that the filtering capability be incorporated into the inserts in a manner that will permit full interchangeability between the filtered inserts and their unfiltered counterparts. In particular, any filtered insert should retain substantially the same dimensions as the corresponding unfiltered insert so that either can be mounted within the same aperture in a standard shell. Also, both the filtered and unfiltered versions of an insert should have the same contact placement so that either can be connected to appropriate mating connectors. In addition, any filtered insert should be capable of being mounted to a shell in a removable manner to retain the flexibility of the assembly.

Filtered, multiple-contact connectors usually must be electrically coupled to external grounding structure to properly dissipate the filtered energy. In prior connectors, this is frequently accomplished by soldering or otherwise permanently connecting the connector grounding plane to external grounding structure. A permanent connection of this type is not suitable for use in the above-described connector assemblies as it would prevent the inserts from being easily mounted to or removed from the shells. Other filtered connectors utilize relatively complex spring mounts to couple the connector grounding plane to external ground. These are relatively expensive and are also not conducive to quick mounting and removal of inserts from the shells of modular connector assemblies.

SUMMARY OF THE INVENTION

In accordance with the present invention, an electrical connector assembly is provided which comprises a conductive shell including at least one insert receiving aperture; a filtered connector insert positioned within the insert-receiving aperture and including a housing, at least a portion of which is electrically conductive, at least one electrical contact within the housing, filter means within the housing electrically coupled to the at least one contact for filtering interference, and means for electrically coupling the filter means to the conductive portion of the housing for providing a ground path from the filter means to the conductive housing portion for dissipating filtered interference; and means for electrically coupling the conductive housing portion of the insert to the conductive shell when the insert is positioned in the insert-receiving aperture for providing an external grounding path from the conductive housing portion to the shell.

In accordance with the invention, the filtered insert is constructed such that a grounding path from the insert to the external shell is provided automatically when the insert is positioned within the shell. In addition, the grounding path is provided in a manner that permits the insert to be easily mounted to or removed from the shell whenever desired, thereby retaining the flexibility of the modular construction.

According to the presently preferred embodiment, the filter means comprises a pi-section LC filter containing a pair of monolithic planar capacitors. The planar capacitors are electrically coupled to the conductive portion of the insert housing by a conductive solder to provide a grounding path through the solder to the housing portion. Grounding from the conductive housing portion to the shell is provided automatically upon mounting the insert to the shell through a surface on the housing portion positioned to contact the shell and through a plurality of conductive mounting screws extending through apertures in the conductive housing portion and the shell to mount the insert within the shell.

With the present invention, a ground path is provided from the filter to external ground without any permanent solder connections to the external grounding structure and without the use of complex spring mounts. The convenience and flexibility of the modular connector assembly is, accordingly, retained while permitting the use of filtered connector inserts therein whenever desired.

The filtered connector insert preferably has the same dimensions and contact placement as its unfiltered counterpart, and is fully interchangeable therewith. This permits the filtered insert to be mounted at the same location within the same standard shell, and to be connected to the same mating connector as its corresponding unfiltered insert.

Further advantages and specific details of the invention will be set forth hereinafter in the following detailed description of a preferred embodiment taken in conjunction with the drawings.

DETAILED DESCRIPTION OF THE PREFERRED EMBODIMENT

Figure 1:
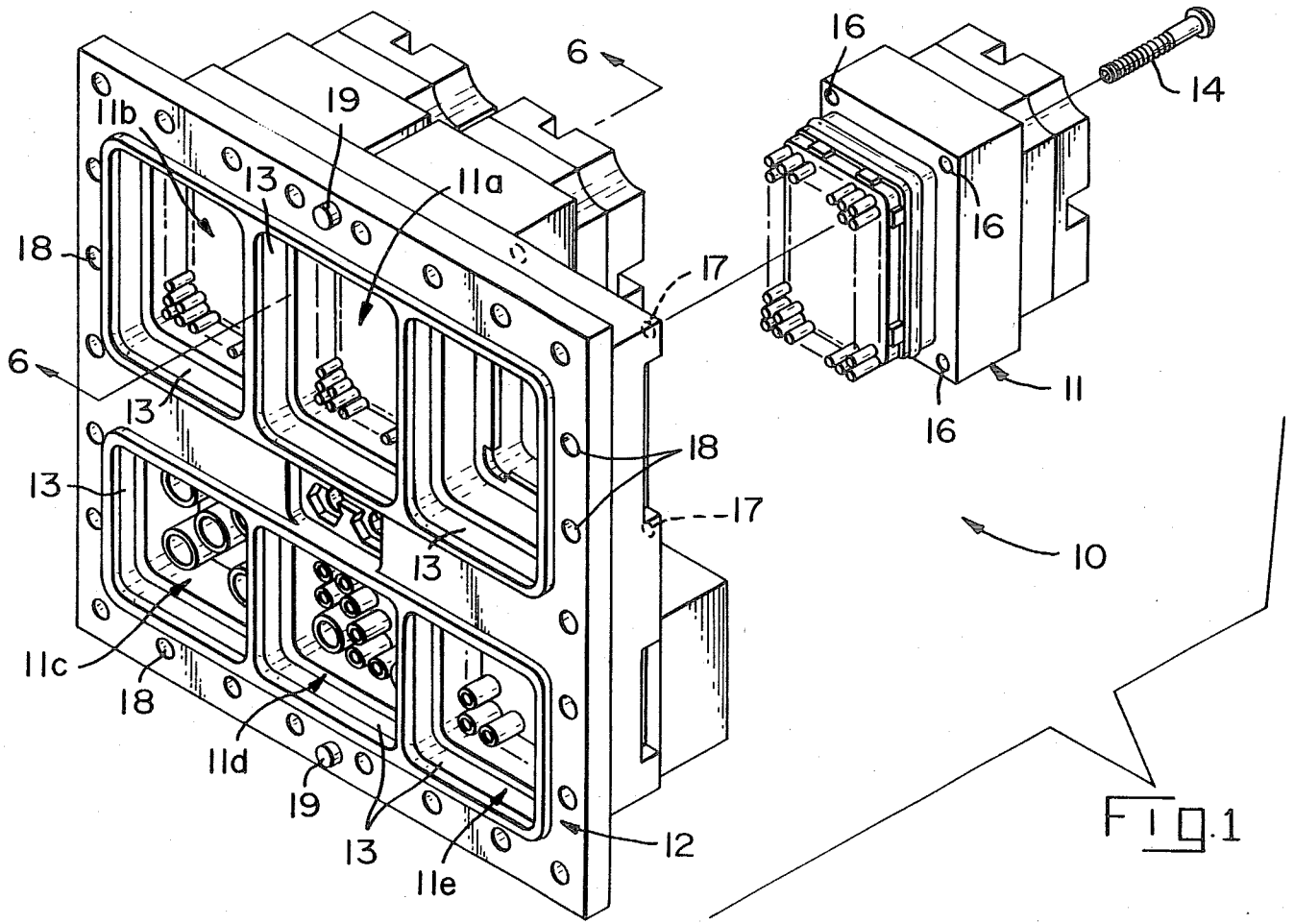
FIG. 1 is a perspective and exploded view of a connector assembly incorporating a filtered connector insert according to a presently preferred embodiment of the invention.

FIG. 1 illustrates a connector assembly according to a presently preferred embodiment of the invention. The assembly is generally designated by reference numeral 10, and comprises a plurality of electrical connector inserts 11–11*e* supported within an outer shell 12. In particular, shell 12 is configured to define a plurality of insert-receiving apertures 13; and inserts 11–11*e* are adapted to be positioned within apertures 13 and secured therein by a plurality of mounting screws 14 extended through aligned apertures 16 and 17 in the inserts and the shell, respectively.

For convenience and flexibility connector assembly 10 is of modular construction. Both the outer shell and the connector inserts are manufactured in a variety of configurations; and to construct an assembly suitable for a particular application of interest, it is only necessary to select the appropriate shell and inserts and to secure the inserts within the shell using mounting screws 14. The assembly so constructed can then be mounted to a bulkhead or other mounting surface by screws or the like extended through apertures 18 positioned around the periphery of the shell 12.

The inserts 11–11*e* are mounted within the outer shell 12 in a removable manner with mounting screws 14 such that one or more inserts can easily be removed or replaced when desired without replacing the assembly as a whole and without interfering with other inserts in the assembly.

Connector assembly 10 comprises a receptacle connector assembly, and, as is known to those skilled in the art, is adapted to be mated with a complementary plug connector assembly (not shown) to complete electrical circuits through the connector. A pair of dowels 19 may be provided on shell 12 to assist in aligning the connector assemblies.

In the embodiment of FIG. 1, shell 12 is configured to define six insert-receiving apertures 13 for receiving and supporting six connector inserts 11–11*e*. Other shell configurations may be provided to support one or any desired plurality of inserts, and it is not intended to limit the invention to any particular shell configuration. Similarly, in the embodiment illustrated in FIG. 1, several insert configurations are shown which differ in the number, type and placement of their contacts. These are intended to be exemplary only, and it is also not intended to restrict the invention to any particular insert configuration.

There are many applications in which it would be desirable for one or more of the connector inserts in connector assembly 10 to have a filtering capability, for example, to supress EMI or RFI interference or other unwanted signals which may exist in circuits connected by the inserts. To retain the convenience and flexibility of the modular construction of assembly 10, however, it is desirable that any filtered insert be fully interchangeable with its unfiltered counterpart. For example, a filtered insert should retain the same dimensions and the same contact placement as its corresponding unfiltered insert so that either insert can be mounted within the same insert-receiving aperture 13 of the same shell 12, and can be connected to the same mating connector. In addition, it is desirable that the filtered insert be easily mounted to and removed from the shell 12 in a manner similar to the unfiltered inserts to permit replacement of the insert when desired.

Connector insert 11 in FIG. 1 comprises a filtered connector insert possessing the above characteristics and is illustrated in greater detail in FIGS. 2–7. Of course, inserts 11*a*–11*e* could also be filtered, if desired.

Figure 2:
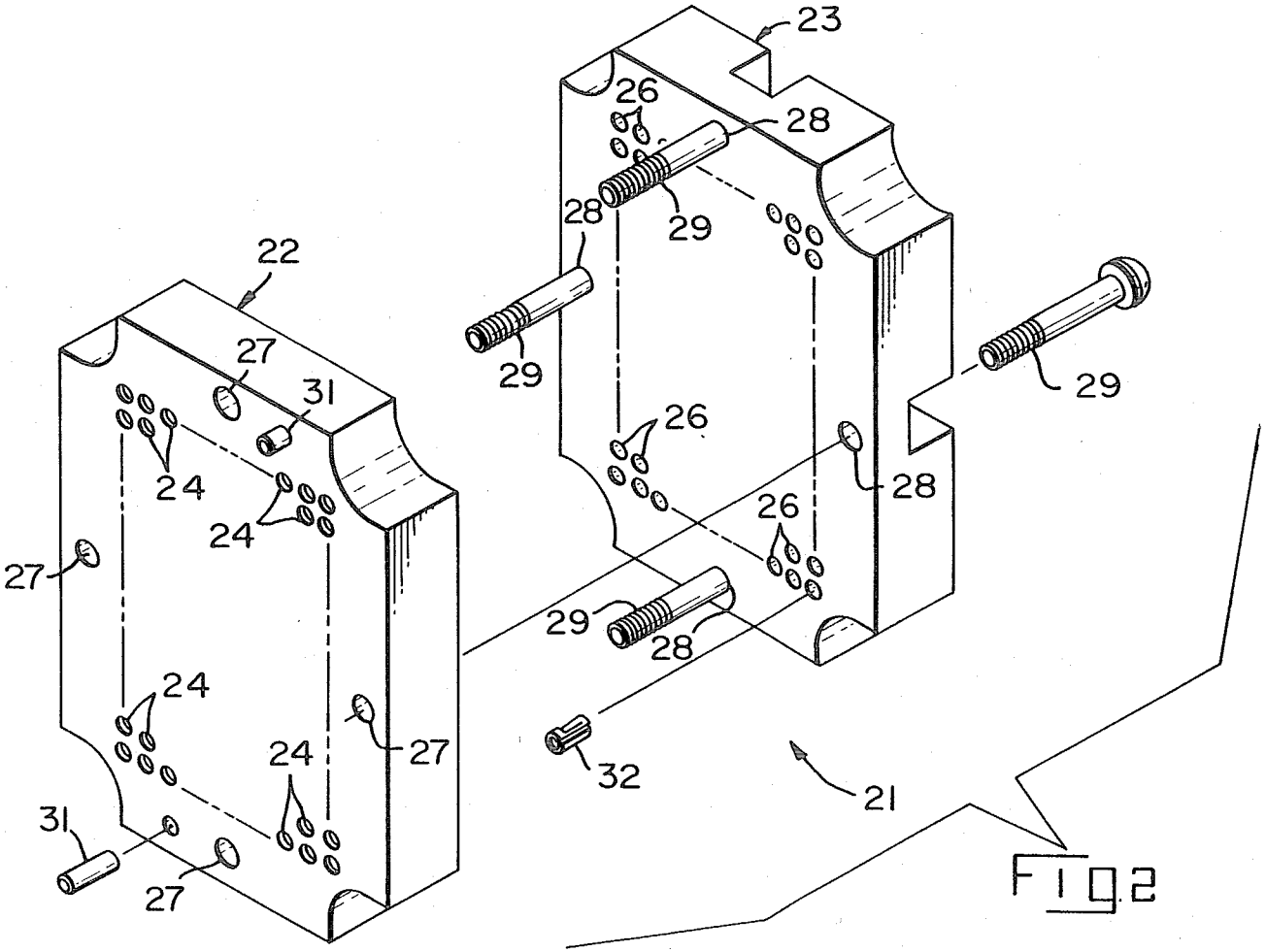
FIG. 2 is a perspective and exploded view of the rear housing subassembly of the connector insert of FIG. 1.

FIG. 2 illustrates the rear housing subassembly 21 of connector insert 11. Subassembly 21 includes a rear housing plate 22 and a rear retainer plate 23, both of which are preferably formed of a relatively rigid dielectric material such as a rigid molded plastic.

Figure 6:
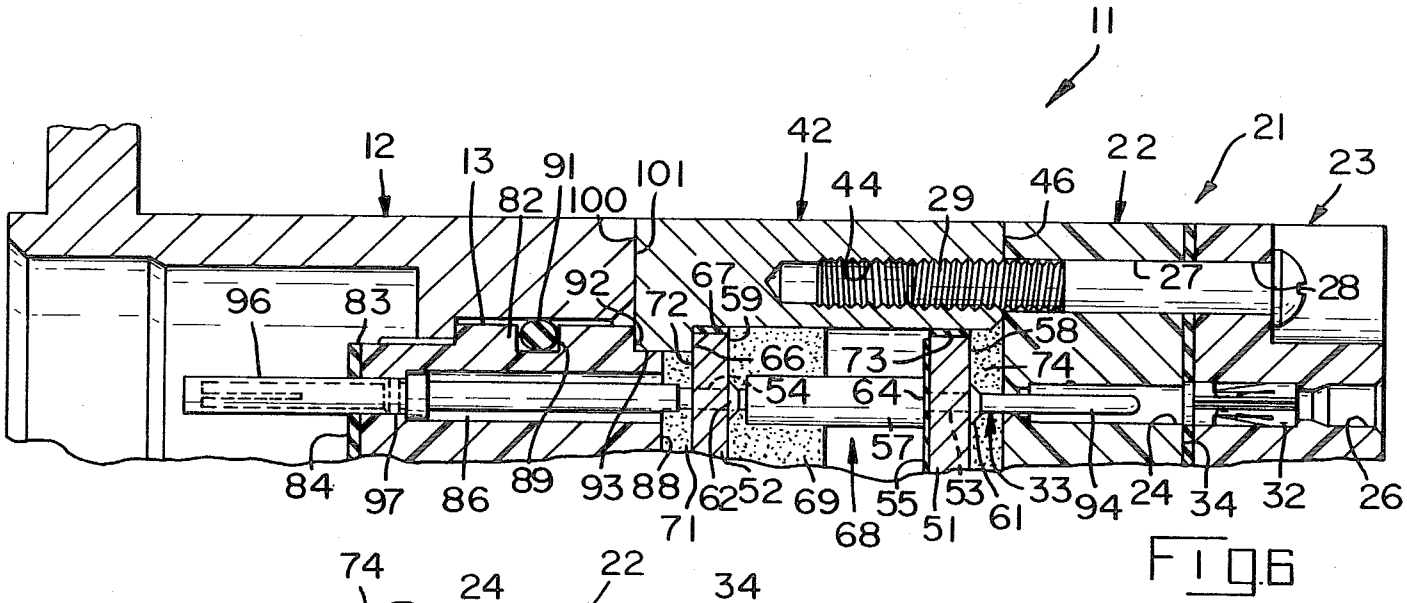
FIG. 6 is a partial cross-sectional view of the connector insert of FIGS. 1 and 5 mounted in the shell, taken along the line 6—6 of FIG. 1.

A plurality of apertures 24 extends through rear housing plate 22 and a plurality of apertures 26 extends through rear retainer plate 23. Apertures 24 and 26 are arranged in a generally rectangular pattern and are positioned to be in alignment with one another when plates 22 and 23 are assembled together as shown in FIG. 6. As is also illustrated in FIG. 6, the apertures 24 in rear housing plate 22 are adapted to receive the ends of a plurality of contacts 33 which are supported within insert 11, and the apertures 26 in rear retainer plate 23 are adapted to receive and support a plurality of retainer clips 32 for connecting the contacts to external circuits.

In the embodiment illustrated and described herein, connector insert 11 comprises a 150 contact insert. Accordingly, plates 22 and 23, as well as other contact-receiving components of the insert, have 150 apertures extending therethrough.

Plates 22 and 23 also include a plurality of aligned peripheral apertures 27 and 28, respectively, to receive securing screws 29. In addition, a pair of dowels 31 is mounted to and extends from rear housing plate 22 to assist in aligning rear housing subassembly 21 as hereinafter described.

To assemble rear housing subassembly 21, retainer clips 32 are inserted into apertures 26 of rear retainer plate 23. Plates 22 and 23 are then positioned against one another with an adhesive layer 34 therebetween as shown in FIG. 6. Layer 34 functions as both an adhesive and a sealant to both bond the plates together and to provide an effective seal therebetween, and in the preferred embodiment, comprises a silicone adhesive. Dowels 31 are then bonded within recesses in rear housing plate 22 to complete the subassembly 21.

Figure 7:
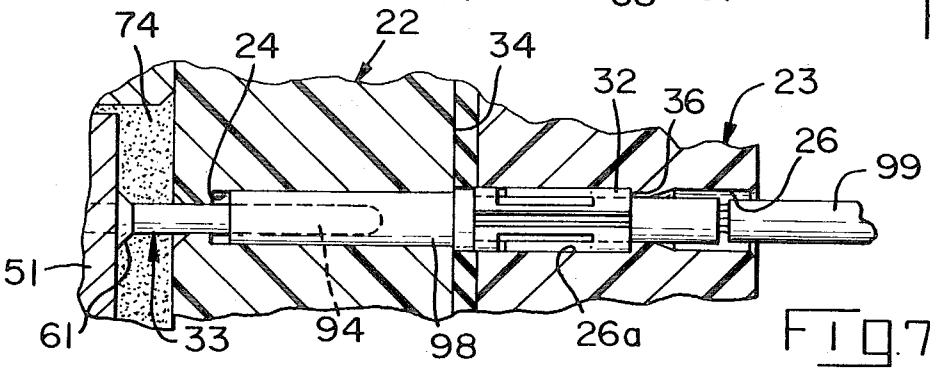
FIG. 7 is a partial cross-sectional view of the connector insert of FIGS. 1 and 5 to illustrate a detail thereof.

As is most clearly illustrated in FIG. 7, retainer clips 32 are supported within portions 26*a* of apertures 26 which are of slightly enlarged diameter. Accordingly, when plates 22 and 23 are bonded together, clips 32 will be firmly retained in aperture portions 26a between shoulders 36 and plate 22.

Figure 3:
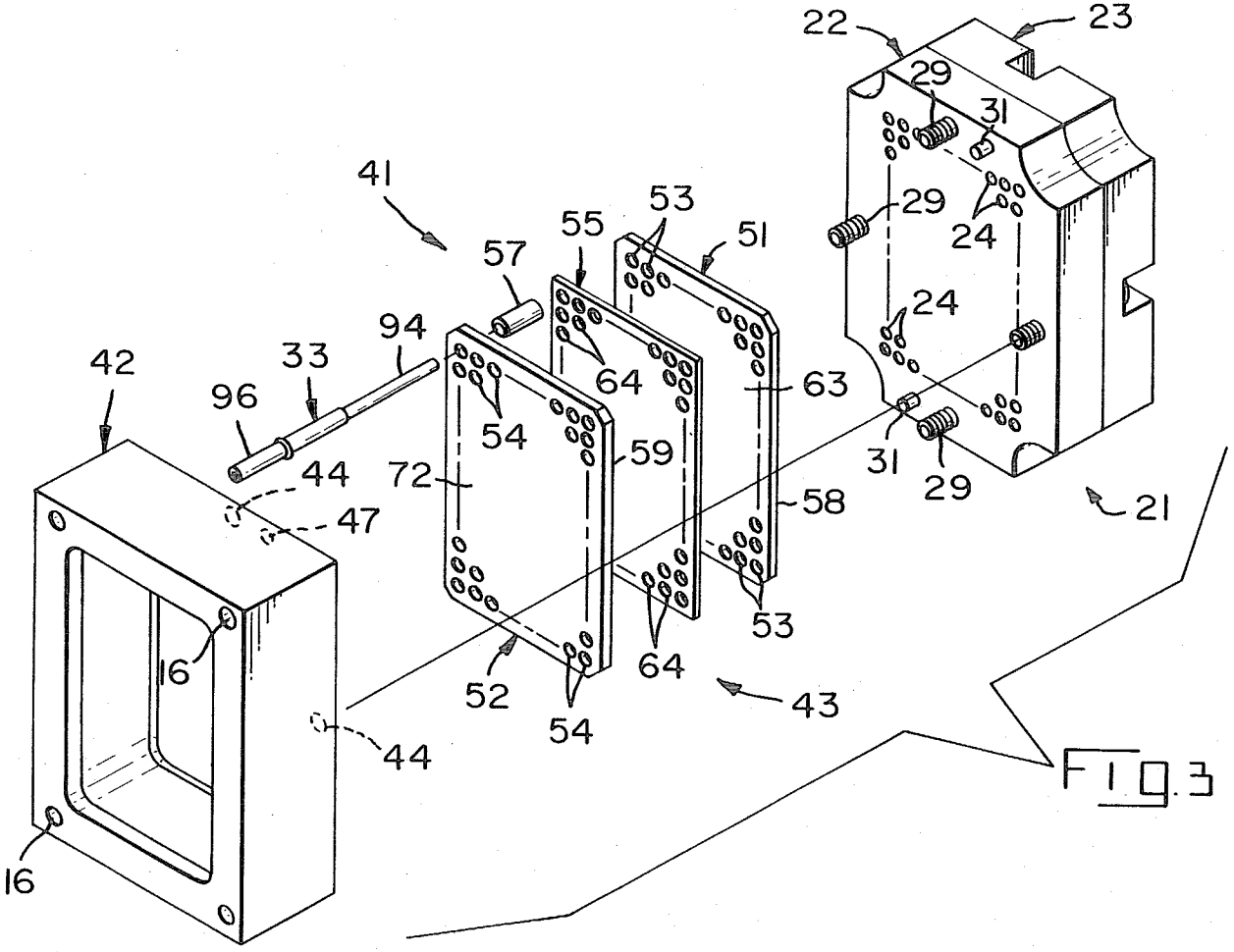
FIG. 3 is a perspective and exploded view of the frame/planar filter subassembly of the connector insert of FIG. 1 in association with the rear housing subassembly.

FIG. 3 illustrates the frame/planar filter subassembly 41 of insert 11 in association with rear housing subassembly 21. Frame/planar filter subassembly 41 includes a frame 42 and a filter assembly 43 retained within the frame. Frame 42 comprises an annular, electrically conductive member and, in the presently preferred embodiment, is composed of nickel-plated aluminum.

Frame 42 includes a first plurality of apertures 44 which extend partially into frame 42 from rear face 46 for receiving securing screws 29 as shown in FIG. 6, a second plurality of apertures 47 which also extend partially into frame 42 from face 46 for receiving dowels 31 on plate 22, and a third plurality of apertures 16 which extend through frame 42 for receiving mounting screws 14 (FIG. 1) to mount the insert to shell 12.

Filter assembly 43 comprises a pi-section LC filter assembly commonly used in electrical filtering applications and need not be described in detail herein. Details of such a filter assembly are, however, fully disclosed in U.S. Pat. No. 4,262,268. Briefly, the filter assembly 43 comprises a pair of monolithic planar capacitors 51 and 52 between which is positioned a plurality of magnetic tubular elements such as ferrite tubes 57. Planar capacitors 51 and 52 each have a plurality of apertures, 53 and 54, respectively, and contacts 33 extend through the apertures 53 and 54 and through the ferrite tubes 57. Each contact 33 is mechanically and electrically coupled to surface 58 of planar capacitor 51 and to surface 59 of planar capacitor 52 by a conductive solder as illustrated at 61 and 62 in FIG. 6. An insulating sheet 55 of, for example, unclad epoxy glass laminate is positioned against surface 63 of planar capacitor 51. Insulating sheet 55 also contains a plurality of apertures 64 through which contacts 33 extend.

As is described in U.S. Pat. No. 4,262,268, filter assembly 43 functions as an LC circuit with the ferrite tubes providing inductances in coaction with contacts 33, and such a filter is highly effective in filtering EMI and RFI interference from circuits connected through insert 11.

To assemble frame/planar filter subassembly 41, contacts 33 are inserted through apertures 54 in monolithic planar capacitor 52 and soldered thereto by solder 62. Planar capacitor 52 with contacts attached is then positioned within frame 42 such that it rests upon shoulder 66 on frame 42 as shown in FIG. 6. Planar capacitor 52 is then bonded to frame 42 around its periphery by a conductive adhesive 67 such as a conductive epoxy. As will be explained more fully hereinafter, conductive adhesive 67 not only physically attaches capacitor 52 to frame 42, but also provides a grounding path from the capacitor 52 to the frame 42.

The ferrite tubes 57 are then positioned over contacts 33, and a portion of cavity 68 defined by planar capacitor 52 and frame 42 is filled with a potting material 69 such as an epoxy resin. A layer of epoxy resin potting material 71 is also applied over the surface 72 of planar capacitor 52 as shown in FIG. 6.

Insulating sheet 55 and monolithic planar capacitor 51 are then positioned in frame 42 on top of ferrite sleeves 57 with contacts 33 extending through the apertures 64 and 53 therein. The contacts 33 are then mechanically and electrically connected to planar capactior 51 by conductive solder 61. Preferably solder 61 and 62 comprise performed rings of solder which are positioned around contacts 33, and then heated to attach the contacts to the capacitors 51 and 52.

Planar capacitor 51 is then bonded to frame 42 around its periphery by conductive adhesive 73 such as an epoxy adhesive, and a layer of potting material 74 is applied over surface 58 of planar capacitor 51 to complete the frame/planar filter subassembly 41. Subassembly 41 is then attached to rear housing subassembly 21 extending securing screws 29 through aligned apertures 28, 27 and 44 in rear retainer plate 23, rear housing plate 22 and frame 42, respectively.

Frame/planar filter subassembly 41 with metal frame 42 around it periphery and potting material within and covering each face thereof comprises a sturdy, substantially fully enclosed unit capable of effectively withstanding relatively severe stresses that may be encountered during use of the connector.

Figure 4:
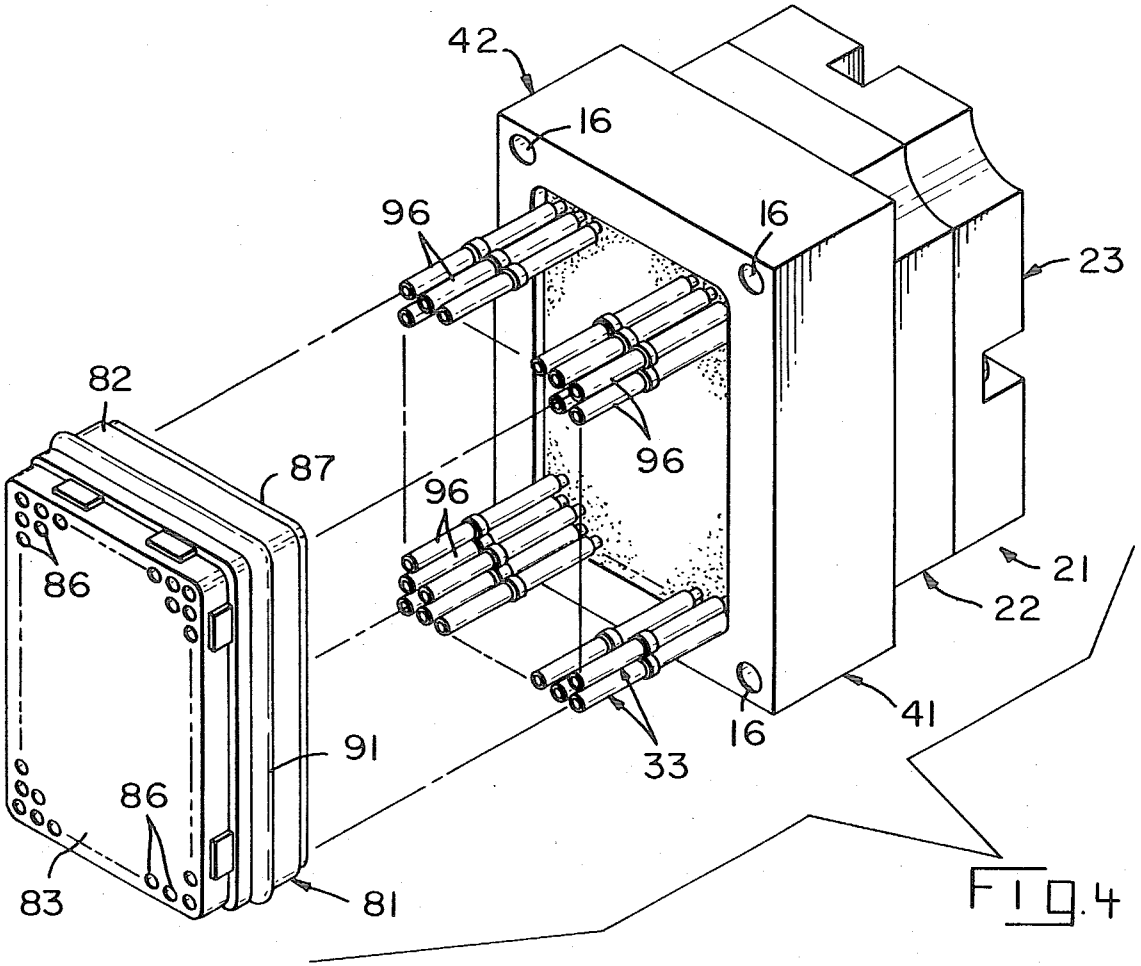
FIG. 4 is a perspective and exploded view of the front housing subassembly of the connector insert of FIG. 1 in association with the assembled rear housing and frame/planar filter subassemblies.
Figure 5:
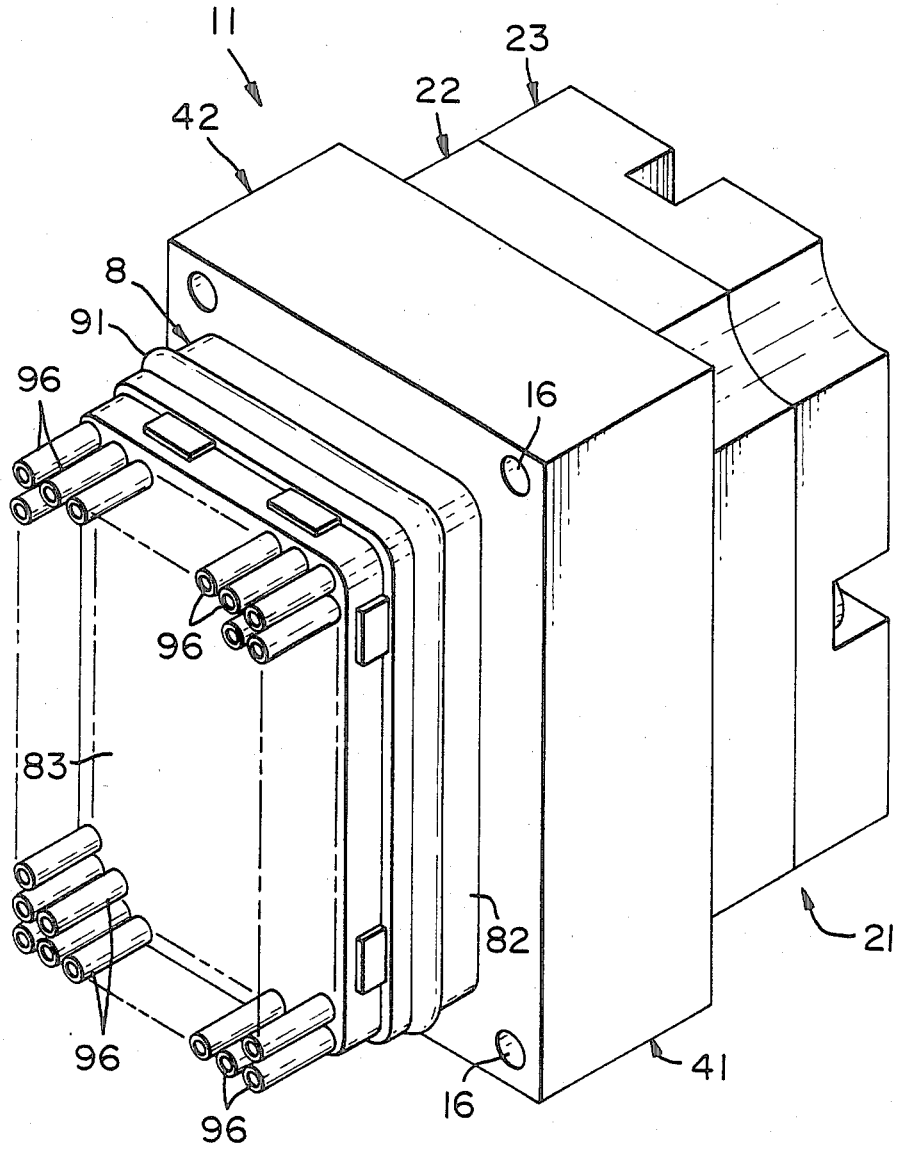
FIG. 5 is a perspective view of the fully assembled connector insert of FIG. 1 in greater detail.

FIG. 4 illustrates the front housing subassembly 81 of insert 11 in association with the assembled rear housing subassembly 21 and frame/planar filter subassembly 41.

Front housing subassembly 81 comprises a front housing plate 82 of a rigid dielectric material such as a rigid molded plastic. A layer 83 of, for example, fluorosilicone material is bonded to the front face 84 of plate 82 as best shown in FIG. 6 to function as a intefacial seal to seal the front face of connector insert 11 and to seal between connector insert 11 and a mating plug connector (not shown).

Front housing plate 82 has a plurality of apertures 86 extending therethrough for receipt of contacts 33. In addition, plate 82 has a portion 87 of reduced cross section which is sized to be inserted into frame 42 with rear surface 88 of plate 82 in contact with potting material layer 71.

Front housing plate 82 is also provided with an annular groove 89 around its periphery, and a rubber O-ring seal 91 is positioned within groove 89. Seal 91 functions to seal between the connector insert 11 and the seal 12 when the insert is mounted within an insert-receiving aperture 13 in the shell as shown in FIG. 6.

To complete connector insert 11, front housing subassembly 81 is inserted into frame 42 and secured thereto by a suitable adhesive, such as epoxy adhesive, on interfaces 92 and 93 therebetween as shown in FIG. 6.

As also shown in FIG. 6, contacts 33 include elongated pin contact portions 94 and socket contact portions 96 which are secured together by crimping or the like as shown at 97. Pin contact portions 94 extend from front housing plate 82, through capacitors 51 and 52 and insulating sheet 55 into apertures 24 in rear housing plate 22; and socket contact portions 96 extend out the front housing subassembly 81 to receive terminals on a mating connector member. Contacts 33 can be formed of berylium copper or another suitable, electrically conductive material.

Pin contact portions 94 extend into apertures 24 in rear housing plate 22 as best shown in FIG. 7, and are adapted to be connected to terminals 98 attached to the ends of conductor wires 99 which are, in turn, connected to external circuits to be connected by the connector. Terminals 98 extend through retainer clips 32 in the apertures 26 in rear retainer plate 23 and are firmly retained in position therein by clips 32.

Filtered connector insert 11 is a sturdy, well-protected module that is substantially fully enclosed within a rigid housing defined by front and rear housing subassemblies 81 and 21 and peripheral conductive frame 42 (see FIGS. 1, 5 and 6), and can be anticipated to operate reliably for long periods of time.

Connector insert assembly 11 is mounted within shell 12 by positioning insert 11 into an appropriately sized insert-receiving aperture 13 and then attaching the insert to shell 12 by mounting screws 14 extended through aligned apertures 16 and 17 in insert 11 and shell 12, respectively. Assembly 10 can be mounted to a bulkhead or other mounting surface, and the insert 11, as well as the other inserts 11*a*–11*e* in the assembly, can be attached to circuitry in the bulkhead. A mating connector assembly (not shown) can be connected to assembly 10 to complete electrical circuits through the connector.

If it is desired to replace connector insert 11, or any one of the other inserts 11*a*–11*e*, it is only necessary to unscrew the appropriate mounting screws 14, remove the insert, and replace it with a new insert.

When filtered connector insert 11 is mounted to shell 12, a continuous grounding path is automatically provided from the monolithic planar capacitors 51 and 52 to the shell 12 as best seen in FIG. 6. Specifically, as indicated above, monolithic planar capacitors 51 and 52 are electrically coupled to conductive frame 42 by conductive epoxy 73 and 67, respectively, applied between the outer peripheral surfaces of capacitors 51 and 52 and frame 42. When insert 11 is mounted within shell 12, peripheral face 100 of the frame 42 will be placed in contact with surface 101 of conductive shell 12, and, in addition, frame 42 will be in conductive contact with shell 12 through conductive mounting screws 14 used to mount the insert to the shell. Thus, when the insert 11 is mounted to the shell 12, grounding continuity is automatically achieved from monolithic planar capacitors 51 and 52 through conductive epoxy 73 and 66, through frame 42 and to the shell 12, both directly and through mounting screws 14.

With the present invention, therefore, an easy make and break connection from the grounding plane of the insert to external ground is provided. It is not necessary to solder the insert to external ground, or to use relatively complex spring mounting structure to externally ground the insert. The convenience and flexibility of the connector assembly 10 is thus retained while permitting the use of filtered connector inserts in the assembly.

Filtered connector insert 11 has the same external dimensions and the same contact placement as its counterpart unfiltered insert and is thus fully interchangeable therewith.

Although what has been described constitutes a presently preferred embodiment of the invention, numerous modifications are possible without departing from the invention. For example, the filtered insert 11 could be designed with alternative forms of filtering structure including the use of more than two planar capacitors. Also, different types of contacts may be incorporated into the insert, and the insert could be formed in different shapes and with differing contact placements. Accordingly, it should be understood that the invention should be limited only insofar as is required by the scope of the following claims.

We claim:

1. An electrical connector assembly comprising a conductive shell, said conductive shell including at least one insert-receiving aperture;

at least one filtered connector insert removably mounted within said at least one insert-receiving aperture; said insert including:

substantially enclosed housing means, said housing means comprising top and bottom dielectric housing means portions and a conductive peripheral frame;

a plurality of electrical contacts extending within said housing means;

filter means within said housing means and electrically coupled to said plurality of contacts for filtering interference, said filter means comprising a pi-section LC filter including at least two monolithic planar capacitors and a plurality of ferrite tubes therebetween, said planar capacitors having a plurality of apertures, and said plurality of contacts extends through said planar capacitor apertures and through said ferrite tubes; and a conductive adhesive for coupling each of said monolithic planar capacitors to said conductive peripheral frame for providing a ground path from said monolithic planar capacitors to said conductive frame through said conductive adhesive; and at least one conductive fastener for releasably fastening said insert to said shell, said conductive fastener coupling said conductive frame to said conductive shell and providing an external grounding path from said frame to said shell through said fastener.

2. The connector assembly as described in claim 1 and further including a surface on said frame in contact with said shell when said insert is mounted within said insert-receiving aperture for providing a further external grounding path from said frame to said shell across said surface.

3. The connector assembly as described in claim 1, wherein said conductive adhesive comprises a conductive epoxy.

4. The connector assembly as described in claim 1 wherein said frame includes a plurality of apertures and wherein said at least one fastener comprises a plurality of mounting screws extending through said apertures for removably fastening said insert to said shell.

5. A connector insert for use in a connector assembly containing one or more connector inserts removably mounted to an outer shell comprising:

a substantially enclosed housing means, said housing means comprising top and bottom dielectric housing means portions and a conductive peripheral frame;

a plurality of electrical contacts extending within said housing;

filter means within said housing means and electrically coupled to said plurality of contacts for filtering interference, said filter means comprising a pi-section LC filter including at least two monolithic planar capacitors and a plurality of ferrite tubes therebetween, said planar capacitors having a plurality of apertures, said plurality of contacts extending through said planar capacitor apertures and through said ferrite tubes;

a conductive adhesive for coupling each of said monolithic planar capacitors to said conductive peripheral frame for providing a grounding path from said monolithic planar capacitors to said conductive frame through said conductive adhesive; and a plurality of apertures in said frame for receiving a plurality of conductive fasteners for mounting said insert to said shell and for providing an external grounding path from said frame to said shell through said fasteners.

6. A connector insert for use in a connector assembly containing one or more connector inserts removably mounted to an outer shell comprising:

substantially enclosed housing means, at least a portion of said housing means being electrically conductive, said conductive housing means portion comprising a conductive peripheral frame;

a plurality of electrical contacts within said housing means;

filter means within said housing means electrically coupled to said plurality of contacts for filtering interference;

means for electrically coupling said filter means to said conductive housing means portion for providing a grounding path from said filter means to said conductive housing portion through said coupling means for dissipating filtered interference; and means on said conductive housing means portion for removably electrically coupling said housing means portion to said shell comprising a plurality of apertures in said frame for receiving a plurality of conductive fasteners for removably mounting said insert to said shell and for providing an external grounding path from said frame to said shell through said fasteners.

7. The insert as described in claim 6 wherein said filter means includes at least one monolithic planar capacitor having a plurality of apertures through which said plurality of contacts extends, and wherein said means for electrically coupling said filter means to said conductive housing means portion comprises a conductive adhesive coupling the edge of said monolithic planar capacitor to said conductive housing portion.

8. The insert as described in claim 6 wherein said means for removably electrically coupling said housing portion to said shell further includes a surface on said frame positioned to contact said shell when said insert is mounted to said shell.

9. The insert as described in claim 6 wherein said plurality of contacts each includes a pin portion and a socket portion for receiving terminals to connect electrical circuits through said inserts.

10. The insert as described in claim 9 and including retaining clips within said insert for retaining terminals to be connected to said pin portions of said contacts.

11. An electrical connector assembly comprising:

a conductive shell, said shell including at least one insert-receiving aperture;

a filtered connector insert removably fastened within said insert-receiving aperture, said insert including:

housing means, at least a portion of said housing means being electrically conductive; said conductive portion comprising an annular frame defining the periphery of said housing means;

at least one electrical contact means within said housing means;

filter means within said housing means electrically coupled to said at least one contact means for filtering interference;

conductive adhesive means for securing and electrically coupling said filter means to said conductive portion of said housing means, said conductive adhesive providing a grounding path from said filter means to said conductive housing means portion for dissipating filtered interference; and means for electrically coupling said conductive housing means portion of said insert to said conductive shell comprising at least one conductive fastener for removably fastening said conductive housing means portion to said shell and for providing an external grounding path from said conductive housing means portion through said conductive fastener to said shell.

12. The connector assembly as described in claim 11 wherein said annular frame comprises an aluminum frame.

13. The connector assembly as described in claim 11 wherein said shell includes a plurality of insert receiving apertures, and wherein a plurality of connector inserts is positioned within said plurality of insert-receiving apertures and is removably mounted therein, at least one of said plurality of connector inserts comprising a filtered connector insert.

14. The connector assembly as described in claim 11 and further including means for mounting said shell to a mounting surface.

15. The connector assembly as described in claim 11 wherein said conductive adhesive comprises a conductive epoxy.

16. An electrical connector assembly comprising:

a conductive shell, said shell including at least one insert-receiving aperture;

a filtered connector insert removably fastened within said insert-receiving aperture, said insert including:

housing means, at least a portion of said housing means being electrically conductive; said conductive portion comprising an annular frame defining the periphery of said housing means;

a plurality of electrical contact means within said housing means;

filter means within said housing means electrically coupled to said plurality of contact means for filtering interference, said filter means including at least one monolithic planar capacitor electrically coupled to each of said plurality of contact means;

means for electrically coupling said filter means to said conductive portion of said housing means for providing a grounding path from said filter means to said conductive housing means portion for dissipating filtered interference; and means for electrically coupling said conductive housing means portion of said insert to said conductive shell comprising at least one conductive fastener for removably fastening said conductive housing means portion to said shell and for providing an external grounding path from said conductive housing means portion through said conductive fastener to said shell.

17. The connector assembly as described in claim 16 wherein said means for electrically coupling said filter means to said conductive housing means portion comprises a conductive adhesive for securing said at least one monolithic planar capacitor to said conductive housing means portion and for providing a conductive path from said at least one monolithic planar capacitor to said conductive housing means portion through said conductive adhesive.

18. The connector assembly as described in claim 17 wherein said filter means comprises a pi-section LC filter including at least two monolithic planar capacitors having a plurality of ferrite tubes interposed therebetween, said plurality of electrical contacts extending through aligned apertures in said monolithic planar capacitors and through said ferrite tubes, and wherein said conductive adhesive secures the edges of each of said monolithic planar capacitors to said conductive housing means portion and provides conductive paths from said monolithic planar capacitors to said conductive housing means portion through said conductive adhesive.

19. An electrical connector assembly comprising:

a conductive shell, said shell including at least one insert-receiving aperture;

a filtered connector insert removably fastened within said insert-receiving aperture, said insert including:

a filter subassembly means having a plurality of electrical contact means therein, said contact means being electrically coupled to filter means;

housing means including first, second and third portions, said second portion comprising an annular conductive frame member disposed between said first and third portions, and defining the periphery of said housing means, said frame member having a large aperture extending axially therethrough and adapted to receive said filter subassembly means;

means for electrically coupling said filter means to said conductive frame member of said housing means for providing a grounding path from said filter means to said frame member for dissipating filtered interference; and means for electrically coupling said conductive frame member of said insert to said conductive shell comprising at least one conductive fastener for removably fastening said conductive frame member to said shell and for providing an external grounding path from said conductive frame member through said conductive fastener to said shell.

* * * * *